US005662311A

United States Patent [19]

Waedekin et al.

[11] Patent Number: 5,662,311

[45] Date of Patent: Sep. 2, 1997

[54] LIFTING APPARATUS INCLUDING OVERLOAD SENSING DEVICE

[75] Inventors: Curt J. Waedekin, Muskego; Bradley W. Niemi, Racine, both of Wis.

[73] Assignee: Harnischfeger Corporation, St. Francis, Wis.

[21] Appl. No.: 645,192

[22] Filed: May 13, 1996

Related U.S. Application Data

[63] Continuation of Ser. No. 197,315, Feb. 16, 1994, abandoned.

[51] Int. Cl.[6] ..... B66D 1/48

[52] U.S. Cl. ..... 254/273; 254/270

[58] Field of Search ..... 254/269, 270, 254/272, 273

[56] References Cited

U.S. PATENT DOCUMENTS

| | | | |
|---|---|---|---|
| 2,434,138 | 1/1948 | Adams | 254/270 |
| 3,203,672 | 8/1965 | Santos | 254/270 |
| 3,223,385 | 12/1965 | Murakami | 254/270 |
| 3,733,450 | 5/1973 | Ridge et al. | 254/270 |
| 3,889,929 | 6/1975 | Pamer | 254/270 |
| 4,042,213 | 8/1977 | Schreyer et al. | 254/270 |
| 4,305,513 | 12/1981 | Boelz | 254/273 |
| 4,530,245 | 7/1985 | Jacobson | 73/768 |
| 4,953,053 | 8/1990 | Pratt | 361/31 |

FOREIGN PATENT DOCUMENTS 2110634 6/1983 United Kingdom .

OTHER PUBLICATIONS

Force Translator; Revere Transducers, Inc. (Oct. 1991).

*Primary Examiner*—Katherine Matecki
*Attorney, Agent, or Firm*—Michael, Best & Friedrich

[57] ABSTRACT

A load lifting apparatus comprising: a frame; a load engaging mechanism for engaging a load having a weight; a hoist mechanism for raising the load engaging mechanism, the hoist mechanism being mounted on the frame and including a member supporting the load engaging mechanism during lifting of the load, the member having therein an aperture; a sensor disposed in the aperture for detecting a force exerted by the load engaging mechanism on the member, the sensor providing a variable output indicative of the magnitude of the force; and a control for disabling the hoist mechanism when the output reaches a first predetermined value corresponding to the maximum load of the load lifting apparatus.

23 Claims, 2 Drawing Sheets

LIFTING APPARATUS INCLUDING OVERLOAD SENSING DEVICE

This is a Continuation of application Ser. No. 08/197,315, filed Feb. 16, 1994, entitled "LIFTING APPARATUS INCLUDING OVERLOAD SENSING DEVICE", now abandoned.

FIELD OF THE INVENTION

The invention relates to load lifting apparatus such as hoists, and more particularly to load lifting apparatus including a sensor for preventing overloading of the apparatus.

REFERENCE TO THE PRIOR ART

Lifting apparatus for raising and lowering objects or loads, such as hoists, cranes and weighing systems, generally include a frame, a load engaging mechanism such as a bottom block including a hook, a mechanism for raising and lowering the load engaging mechanism, and control means for operating the lifting mechanism. Typically, the raising mechanism includes a rotatable hoist drum and a lifting rope which is connected between the hoist drum and the load engaging mechanism.

To prevent danger to persons and damage to the lifting apparatus and other equipment, lifting apparatus of the type described above typically also includes a device for detecting and preventing mechanical overloading of the apparatus. As used herein, "mechanical overloading" means raising a load having a weight exceeding the maximum capacity of the lifting apparatus.

One type of overload detection apparatus utilizes the mechanical deflection of a loaded member, such as a pin supporting a rotatable sheave over which the lifting rope is reeved, to actuate a switch preventing operation of the raising mechanism when the lifting apparatus is overloaded. This type of arrangement requires precise alignment of the switch actuating mechanism with the deflectable member. Alignment is a labor intensive, time consuming procedure which varies substantially between individual lifting apparatus of an identical type or model.

U.S. Pat. No. 4,953,053 discloses a hoist for raising and lowering objects including an apparatus for detecting mechanical overload of the hoist. The hoist has an alternating current motor connected to an alternating current power supply. The level of current of the power supplied to the motor is compared to a level of power indicative of a mechanical overload condition. If the current signal representative of the actual motor current level equals or exceeds the mechanical overload reference current, then an overload output signal is provided.

SUMMARY OF THE INVENTION

The invention provides a load lifting apparatus which includes a sensor disposed in an aperture in a member for detecting deformation of the aperture and providing a variable output indicative of the magnitude of a force exerted by the load engaging mechanism on the member, and control means for preventing raising the load when the weight of the load exceeds the maximum capacity of the load lifting apparatus.

More particularly, the invention provides a hoist comprising a frame. The hoist also comprises a load engaging mechanism, such as a bottom block including a hook, for engaging a load. The hoist also comprises a hoist mechanism for raising and lowering the bottom block. The hoist mechanism includes a hoist drum and a U-shaped member which is pivotally mounted on the frame. A sheave is mounted between the arms of the U-shaped member. One arm of the U-shaped member has therein an aperture for receiving a sensor. The hoist mechanism also includes a lifting rope supporting the bottom block. The lifting rope extends from the hoist drum, around a sheave on the bottom block, around the sheave mounted on the U-shaped member, around another sheave on the bottom block, and back to the hoist drum.

The hoist also comprises a sensor for detecting a force exerted on the U-shaped member by the lifting rope (and thus by the bottom block and any load thereon). The sensor includes a cylindrical portion which is press-fit into the aperture in one arm of the U-shaped member. The sensor detects deformation of the aperture caused by strain on the arm and provides a variable output which is indicative of the deformation (and thereby is indicative of the force exerted by the lifting rope). Because the aperture receiving the sensor is located in the U-shaped member, the sensor is located in an area which receives minimal stress from loads other than the force exerted by the lifting rope.

The hoist also comprises control means for selectively rotating the hoist drum to raise and lower the bottom block. The control means includes conventional electrical controls operably connected to the hoist motor. A conventional pendant controller is connected to the controls and is selectively operable to rotate the hoist drum in opposite directions to raise and lower the bottom block.

The control means also includes a microprocessor-based load sensing module. The module primarily assists in factory testing and set-up of the hoist. The module is mounted with and connected to the electrical controls. The module is also connected to the sensor and receives the output from the sensor. If the sensor output reaches a first predetermined value corresponding to the maximum load or capacity of the hoist, the module prevents the hoist drum from rotating to raise the bottom block, but permits rotating the hoist drum to lower the bottom block. The module also provides a signal when the sensor output reaches a second predetermined value or "trip point" approaching the maximum capacity of the hoist. The module also displays the weight of the load as a percentage of the maximum capacity of the hoist. If the sensor output reaches a third predetermined value indicating a "slackline condition" , i.e., that the bottom block or attached load has encountered an obstacle and is not fully supported by the lifting rope, the module prevents the hoist drum from rotating to lower the bottom block, but permits rotating the hoist drum to raise the bottom block and load away from the obstacle. The module also records the cumulative period during which the hoist is in operation. The module also records the cumulative number of occurrences of lifting of loads having weights falling in predetermined ranges, such as from 40 to 50 percent or 50 to 60 percent, of the maximum capacity of the hoist.

Other features and advantages of the invention will become apparent to those skilled in the art upon review of the following detailed description, claims and drawings.

Figure 1:
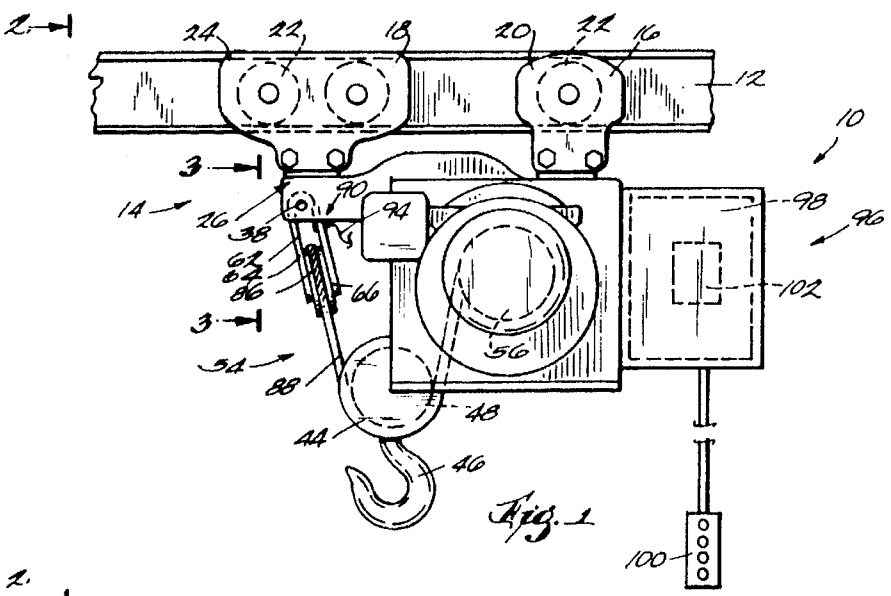
FIG. 1 is a partial side elevational view of a hoist embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Illustrated in the drawings is a load lifting apparatus 10 embodying the invention. The invention can be embodied in various lifting apparatus, such as cranes, weighing systems and hoists. The illustrated embodiment of the invention is a hoist.

The lifting apparatus or hoist 10 (FIGS. 1 and 2) comprises a horizontally extending overhead rail 12. A trolley 14 is supported on the rail 12. The trolley 14 includes spaced wheel assemblies 16 and 18. The wheel assembly 16 includes a wheel bracket 20 having a pair of opposed drive wheels 22 mounted therein for rotation about a horizontal axis. The wheel assembly 18 includes a wheel bracket 24 having two spaced pairs of opposed drive wheels 22 mounted therein for rotation about respective horizontal axes. The drive wheels 22 roll along the rail 12 and support the respective wheel brackets 20 and 24. A drive motor 25 (see FIG. 2) is operably connected to the wheels 22 in the second wheel assembly 18. The drive motor 25 is selectively operable to drive the wheels 22 for moving the trolley 14 in opposite directions along the rail 12.

Figure 2:
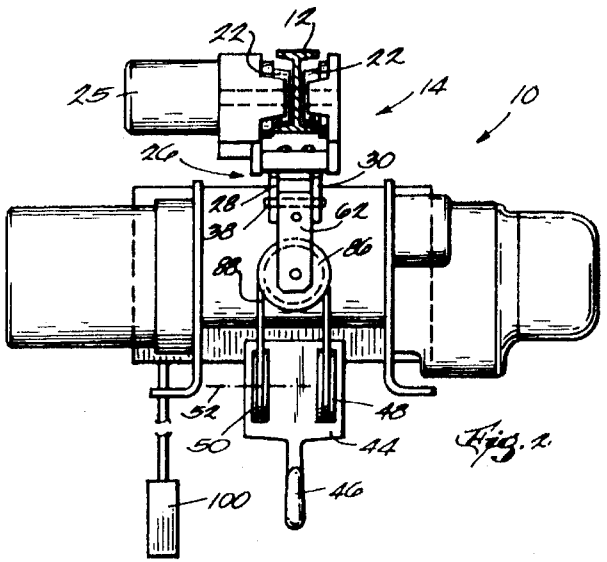
FIG. 2 is an end view taken generally along line 2—2 in FIG. 1.
Figure 3:
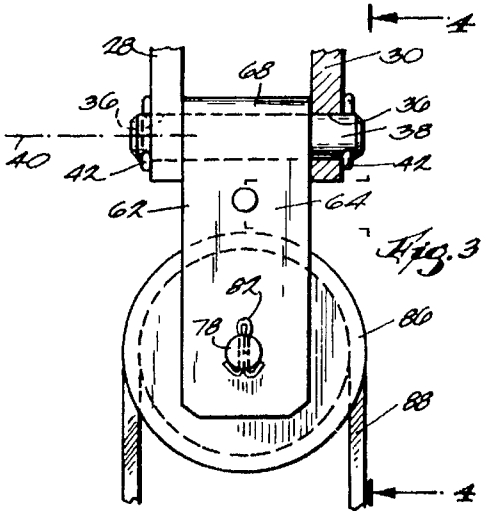
FIG. 3 is an enlarged partial view taken generally along line 3—3 in FIG. 1.

The hoist 10 also comprises (see FIGS. 1 and 2) a frame 26 supported by the wheel assemblies 16 and 18. The frame 26 includes spaced vertically extending portions 28 and 30 beneath the wheel bracket 24. Each frame portion 28 or 30 has therein (see FIG. 3) a respective horizontally extending aperture 36. A pin 38 having a longitudinal axis 40 extends between the frame portions 28 and 30 and through the apertures 36. A pair of cotter pins 42 retain the pin 38 in the apertures 36.

The hoist 10 also comprises a load engaging mechanism for engaging a load. In the illustrated embodiment, the load engaging mechanism is (see FIGS. 1 and 2) a bottom block 44 including a hook 46. In other embodiments, the load engaging mechanism can include a grapple, magnet, bucket or scoop suitably adapted for engaging a load. The bottom block 44 includes (see FIG. 2) spaced sheaves 48 and 50 mounted for rotation about a horizontal axis 52.

The hoist 10 also comprises a mechanism for raising and lowering the bottom block 44. Such mechanism preferably includes (see FIG. 1) a hoist mechanism 54. The hoist mechanism 54 includes a hoist drum 56 supported by the trolley 14 for rotation about a horizontal axis. A conventional hoist motor is operably connected to the hoist drum 56 for rotating the hoist drum 56 in opposite directions to raise and lower the bottom block 44.

The hoist mechanism 54 also includes (see FIGS. 1–4) a U-shaped member 62 which is pivotally mounted on the pin 38. The U-shaped member 62 includes (see FIG. 4) a pair of spaced arms 64 and 66 connected by an arcuate portion 68. The U-shaped member has a width in the direction parallel to the longitudinal axis 40 of the pin 38 which approximates and is slightly less than the distance between the frame portions 28 and 30. The arcuate portion 68 rests on the pin 38 for pivotal movement of the U-shaped member 62 about the longitudinal axis 40 of the pin 38. Each of the arms 64 and 66 includes parallel, spaced inner and outer surfaces 70 and 72. Each arm 64 or 66 (see FIG. 4) has a longitudinal axis 74 parallel to the inner and outer surfaces 70 and 72. The terminal end portion of each arm 64 or 66 has therein a respective aperture 76 extending between the inner and outer surfaces 70 and 72. A pin 78 having a longitudinal axis 80 extends between the arms 64 and 66 and through the apertures 76. A pair of cotter pins 82 retain the pin 78 in the apertures 76. Each arm 64 or 66 has therein, between the arcuate portion 68 and the pin 78, a respective aperture 84 extending transversely between the inner and outer surfaces 70 and 72. A sheave 86 is mounted on the pin 78 for rotation about the longitudinal axis 80.

The hoist mechanism 54 also includes (see FIGS. 1 and 2) a cable or lifting rope 88 supporting the bottom block 44. In the illustrated embodiment, the lifting rope 88 includes opposite end portions reeved around the hoist drum 56 as is known in the art. The lifting rope 88 extends from the hoist drum 56, around the sheave 48 on the bottom block 44, around the sheave 86 mounted on the U-shaped member 62, around the sheave 50 on the bottom block 44, and back to the hoist drum 56. This reeving arrangement is known in the art.

The hoist 10 also comprises (see FIGS. 4 and 5) a sensor 90 for detecting a force exerted on the U-shaped member 62 by the lifting rope 88 (and thus by the bottom block 44 and any load thereon). In the illustrated embodiment of the invention, the sensor 90 is a Model GZ-10 Gozinta® universal force sensor (Revere Transducers, Inc.; Cerritos, Calif.) of the general type disclosed in U.S. Pat. No. 4,530,245, which is hereby incorporated by reference. The sensor 90 includes (see FIG. 5) a cylindrical portion 92 which is press-fit into the aperture 84 in the arm 66 of the U-shaped member 62. An electrical cable 94 extends from the cylindrical portion 92. The sensor 90 detects deformation of the aperture 84 caused by strain on the arm 66 and provides a variable output through the cable 94 indicative of the deformation (and thereby indicative of the force exerted on the U-shaped member 62 by the lifting rope 88).

The hoist 10 also comprises (see FIG. 1) control means 96 for selectively rotating the hoist drum 56 to raise and lower the bottom block 44. As is known in the art, the control means 96 includes conventional electrical controls 98 operably connected to the hoist motor. A conventional pendant controller 100 is connected to the controls 98 and is selectively operable to rotate the hoist drum 56 in opposite directions to raise and lower the bottom block 44.

Figure 4:
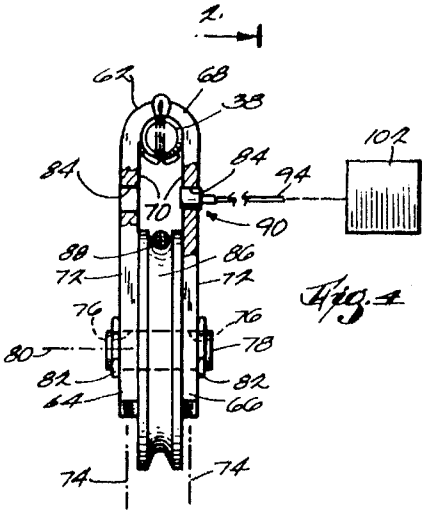
FIG. 4 is a view taken generally along line 4—4 in FIG. 3.
Figure 5:
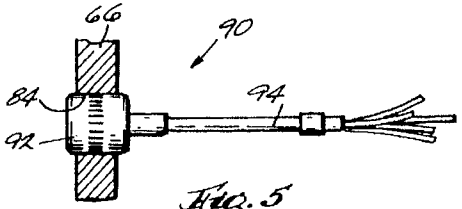
FIG. 5 is an enlarged portion of FIG. 4.

In the illustrated embodiment of the invention, the control means 96 also includes (see FIGS. 1, 4 and 6) a microprocessor-based load sensing module 102 (shown schematically in FIGS. 1 and 4). The module 102 is mounted with and connected to the electrical controls 98. The module 102 is also connected to the cable 94 of the sensor 90 and receives the output from the sensor 90. If the sensor output reaches a first predetermined value corresponding to the maximum load or capacity of the hoist 10, the module 102 prevents the hoist drum 56 from rotating to raise the bottom block 44, but permits rotating the hoist drum 56 to lower the bottom block 44. Thus, the control means 102 disables the raising means when the sensor output reaches the first predetermined value. The module 102 also provides a signal when the sensor output reaches a second predetermined value or "trip" point approaching the maximum capacity of the hoist 10. The signal can be an alarm, siren, beacon or other signal. The trip point can be set at different levels, such as, for example, 80 or 90 percent of the maximum capacity of the hoist 10. The module 102 also has (see FIG. 6) an LCD visual display 104 and displays on the visual display 104 the weight of the load as a percentage of the maximum capacity of the hoist 10. If the sensor output reaches a third predetermined value indicating a "slackline condition", i.e., that the bottom block 44 or attached load has encountered an obstacle and is not fully supported by the lifting rope 88, the module 102 prevents the hoist drum 56 from rotating to lower the bottom block 44, but permits rotating the hoist drum 56 to raise the bottom block 44 and load away from the obstacle. Thus, the control means disables the lowering means when the sensor output reaches the third predetermined value. The module 102 also records the cumulative period during which the hoist 10 is in operation. The module 102 also records the cumulative number of occurrences of lifting of loads having weights falling in predetermined ranges, such as from 40 to 50 percent or 50 to 60 percent, of the maximum capacity of the hoist 10. Although in the illustrated embodiment the module 102 performs all of the above-described functions, in other arrangements the module 102 can be a basic module performing only the overload sensing function, and selected other functions can be provided in additional modules.

Figure 6:
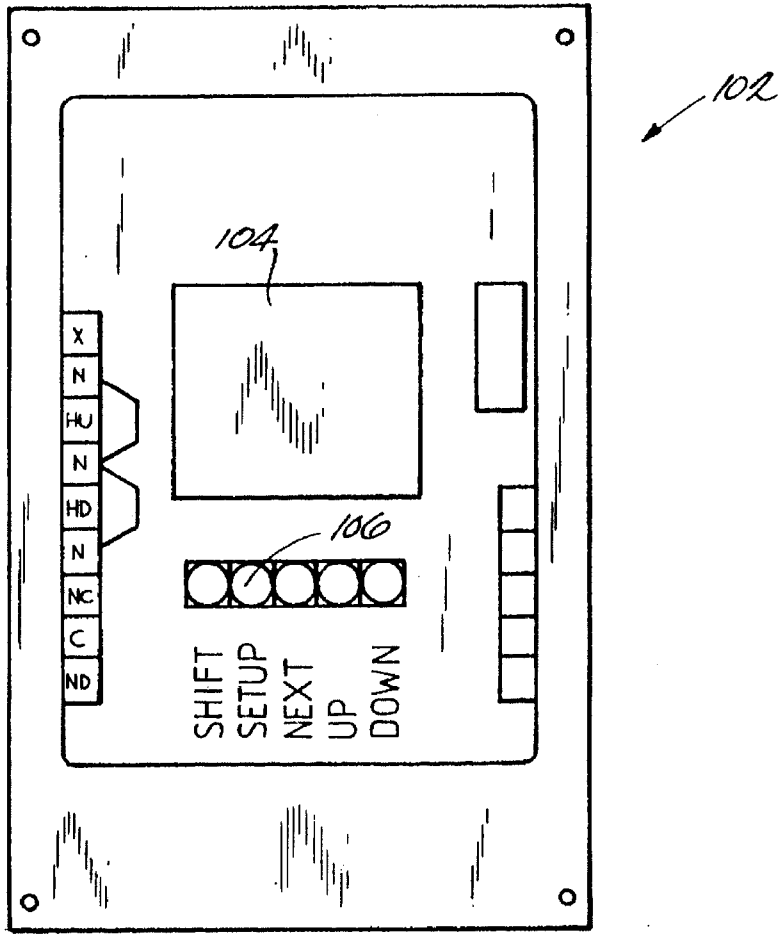
FIG. 6 is an enlarged elevational view of the load sensing module.

The module 102 is calibrated or "set up" by placing the module in a "set-up" mode, such as by pressing a "set-up" button 106 (FIG. 6). With the module 102 in the set-up mode, the hoist 10 is placed in a zero load or "no-load" condition, and the set-up button is pressed to record the sensor output under the no-load condition. Next, with the module 102 still in the set-up mode, the hoist 10 is placed in a maximum load or "full-load" condition, and the set-up button is pressed to record the sensor output under the full-load condition. The hoist 10 including the module 102 is then ready for ordinary use.

In operation, the pendant controller 100 is operated to rotate the hoist drum 56 in the direction lowering the bottom block 44, so that a load can be attached to the hook 46 on the bottom block 44. After the load is attached, the pendant controller 100 is operated to rotate the hoist drum 56 in the direction raising the bottom block 44 and the attached load. As the load is raised, the weight of the load is displayed on the visual display 104 of the module 102 as a percentage of the maximum capacity of the hoist 10. If the weight of the load exceeds the trip point, such as 90 percent of the capacity of the hoist 10, the alarm indicates that the trip point has been exceeded. If the weight of the load exceeds the maximum capacity of the hoist 10, the module 102 prevents rotating the hoist drum 56 to raise the bottom block 44, but permits lowering the bottom block 44 to place the load on the ground. If while attempting to lower the bottom block 44 an obstacle is encountered, so that the bottom block 44 is not fully supported by the lifting rope 88, the module 102 prevents operating the hoist drum 56 in the direction lowering the bottom block 44, but permits raising the bottom block 44 to avoid the obstacle.

Various features of the invention are set forth in the following claims.

We claim:

1. A load lifting apparatus comprising:

a frame;

a load engaging mechanism for engaging a load having a weight;

means for raising said load engaging mechanism, said raising means being mounted on said frame and including a substantially rigid member supporting said load engaging mechanism during lifting of the load, said member having therein an aperture;

a sensor disposed in said aperture for detecting deformation of said aperture and thereby detecting a force exerted by said load engaging mechanism on said member, said sensor providing a variable output indicative of the magnitude of the force; and control means for disabling said raising means when the output reaches a first predetermined value corresponding to the maximum load of said load lifting apparatus, wherein said control means also records the cumulative period during which said load lifting apparatus is in operation, and wherein said control means also records the cumulative number of occurrences of lifting of loads having weights in a predetermined range.

2. A load lifting apparatus as set forth in claim 1 wherein said control means also provides a signal when the output reaches a second predetermined value approaching the first predetermined value.

3. A load lifting apparatus as set forth in claim 1 and further comprising means for lowering said load engaging mechanism, wherein said control means disables said lowering means when the output reaches a third predetermined value indicating that said load engaging mechanism has encountered an obstacle and is not supported by said member.

4. A load lifting apparatus as set forth in claim 1 wherein said control means also provides a visual display of the weight of the load.

5. A load lifting apparatus as set forth in claim 1 wherein said raising means includes a rope, and wherein said member supports said rope.

6. A load lifting apparatus comprising:

a frame;

a load engaging mechanism for engaging a load having a weight;

a hoist mechanism for raising and lowering said load engaging mechanism, said hoist including a hoist drum which is mounted on said frame and which is rotatable in opposite directions to raise and lower said load engaging mechanism, a substantially rigid member which is mounted on said frame and which has therein an aperture, and a lifting rope having a portion reeved around said hoist drum, a portion supporting said load engaging mechanism, and a portion supported by said member;

a sensor disposed in said aperture for detecting deformation of said aperture and thereby detecting a force exerted by said lifting rope on said member, said sensor providing a variable output indicative of the magnitude of the force; and control means for preventing said hoist drum from rotation to raise said load engaging mechanism when the output reaches a first predetermined value corresponding to the maximum load of said load lifting apparatus, wherein said control means also records the cumulative period during which said load lifting apparatus is in operation, and wherein said control means also records the cumulative number of occurrences of lifting of loads having weights in a predetermined range.

7. A load lifting apparatus as set forth in claim 6 wherein said member supports a sheave around which said lifting rope is reeved.

8. A load lifting apparatus as set forth in claim 6 wherein said load engaging mechanism is a bottom block including a sheave around which said lifting rope is reeved.

9. A load lifting apparatus as set forth in claim 6 wherein said control means also provides a signal when the output reaches a second predetermined value approaching the first predetermined value.

10. A load lifting apparatus as set forth in claim 6 wherein said control means prevents said hoist drum from rotation to lower said load engaging mechanism when the output reaches a third predetermined value indicating that said load engaging mechanism has encountered an obstacle and is not supported by said lifting rope.

11. A load lifting apparatus as set forth in claim 6 wherein said control means also provides a visual display of the weight of the load.

12. A load lifting apparatus comprising:

an overhead rail;

a frame;

a bottom block for engaging a load having a weight, said bottom block including a first sheave mounted for rotation about a generally horizontal axis;

a hoist mechanism for raising and lowering said bottom block, said hoist including a hoist drum which is mounted on said frame and which is rotatable in opposite directions to raise and lower said bottom block, a substantially rigid member which is mounted on said frame and which has therein an aperture, a lifting rope having a first portion reeved around said hoist drum, a portion reeved around said first sheave, and a portion supported by said member;

a sensor disposed in said aperture for detecting a force exerted by said lifting rope on said member, said sensor detecting deformation of said aperture and providing an output indicative of the magnitude of the force causing the deformation; and control means for preventing said hoist drum from rotation to raise said bottom block when the output reaches a first predetermined value corresponding to the maximum load of said load lifting apparatus, for providing a signal when the output reaches a second predetermined value approaching the first predetermined value, and for preventing said hoist drum from rotation to lower said bottom block when the output reaches a third predetermined value indicating that said bottom block has encountered an obstacle and is not supported by said lifting rope, wherein said control means also provides a visual display of the weight of the load, records the cumulative period during which said load lifting apparatus is in operation, and records the cumulative number of occurrences of lifting of loads having weights in a predetermined range.

13. A load lifting apparatus as set forth in claim 12 and wherein said member supports a second sheave for rotation about a second generally horizontal axis, said bottom block includes a third sheave mounted for rotation about the first axis, and said lifting rope includes a portion reeved around said second sheave, a portion reeved around said third sheave, and a second portion reeved around said hoist drum.

14. A load lifting apparatus comprising:

a frame;

a load engaging mechanism for engaging a load having a weight;

means for raising said load engaging mechanism, said raising means being mounted on said frame and including a member supporting said load engaging mechanism during lifting of the load, a sensor for detecting a force exerted by said load engaging mechanism on said member, said sensor providing a variable output indicative of the magnitude of the force; and control means for disabling said raising means when the output reaches a first predetermined value corresponding to the maximum load of said load lifting apparatus, wherein said control means also records the cumulative period during which said load lifting apparatus is in operation, and wherein said control means also records the cumulative number of occurrences of lifting of loads having weights in a predetermined range.

15. A load lifting apparatus as set forth in claim 14 wherein said control means also provides a signal when the output reaches a second predetermined value approaching the first predetermined value.

16. A load lifting apparatus as set forth in claim 14 and further comprising means for lowering said load engaging mechanism, wherein said control means disables said lowering means when the output reaches a third predetermined value indicating that said load engaging mechanism has encountered an obstacle and is not supported by said member.

17. A load lifting apparatus as set forth in claim 14 wherein said control means also provides a visual display of the weight of the load.

18. A load lifting apparatus comprising:

a frame;

a load engaging mechanism for engaging a load having a weight;

a hoist mechanism for raising and lowering said load engaging mechanism, said hoist including a hoist drum which is mounted on said frame and which is rotatable in opposite directions to raise and lower said load engaging mechanism, a member mounted on said frame, and a lifting rope having a portion reeved around said hoist drum, a portion supporting said load engaging mechanism, and a portion supported by said member;

a sensor for detecting a force exerted by said lifting rope on said member, said sensor providing a variable output indicative of the magnitude of the force; and control means for preventing said hoist drum from rotation to raise said load engaging mechanism when the output reaches a first predetermined value corresponding to the maximum load of said load lifting apparatus, wherein said control means also records the cumulative period during which said load lifting apparatus is in operation, and wherein said control means also records the cumulative number of occurrences of lifting of loads having weights in a predetermined range.

19. A load lifting apparatus set forth in claim 18 wherein said member supports a sheave around which said lifting rope is reeved.

20. A load lifting apparatus as set forth in claim 18 wherein said load engaging mechanism is a bottom block including a sheave around which said lifting rope is reeved.

21. A load lifting apparatus as set forth in claim 18 wherein said control means also provides a signal when the output reaches a second predetermined value approaching the first predetermined value.

22. A load lifting apparatus as set forth in claim 18 wherein said control means prevents said hoist drum from rotation to lower said load engaging mechanism when the output reaches a third predetermined value indicating that said load engaging mechanism has encountered an obstacle and is not supported by said lifting rope.

23. A load lifting apparatus as set forth in claim 18 wherein said control means also provides a visual display of the weight of the load.

* * * * *